US008053063B2

(12) United States Patent
Sandberg et al.

(10) Patent No.: US 8,053,063 B2
(45) Date of Patent: Nov. 8, 2011

(54) COATED CUTTING INSERT FOR MILLING APPLICATIONS

(75) Inventors: Anna Sandberg, Sala (SE); Andreas Larsson, Fagersta (SE); Tommy Larsson, Angelsberg (SE)

(73) Assignee: Seco Tools AB, Fagersta (SE)

( * ) Notice: Subject to any disclaimer, the term of this patent is extended or adjusted under 35 U.S.C. 154(b) by 317 days.

(21) Appl. No.: 12/208,387

(22) Filed: Sep. 11, 2008

(65) Prior Publication Data

US 2009/0074520 A1 Mar. 19, 2009

(30) Foreign Application Priority Data

Sep. 13, 2007 (SE) ..... 0702045

(51) Int. Cl.
*B32B 9/00* (2006.01)

(52) U.S. Cl. ..... 428/216; 51/307; 51/309; 428/336; 428/469; 428/472; 428/698; 428/701; 428/702

(58) Field of Classification Search ..... 51/307, 51/309; 428/216, 336, 469, 472, 698, 701, 428/702

See application file for complete search history.

(56) References Cited

U.S. PATENT DOCUMENTS

| | | | | |
|---|---|---|---|---|
| 5,487,625 | A * | 1/1996 | Ljungberg et al. | 51/307 |
| 5,863,640 | A * | 1/1999 | Ljungberg et al. | 428/336 |
| 6,177,178 | B1 * | 1/2001 | Ostlund et al. | 428/702 |
| 6,333,098 | B1 * | 12/2001 | Olsson et al. | 428/701 |
| 6,337,152 | B1 * | 1/2002 | Kukino et al. | 428/698 |
| 6,632,514 | B1 * | 10/2003 | Sulin et al. | 51/309 |
| 7,135,221 | B2 * | 11/2006 | Ruppi et al. | 428/216 |

FOREIGN PATENT DOCUMENTS

| | | | |
|---|---|---|---|
| EP | 0753603 | B1 | 1/2000 |
| EP | 1103635 | B1 | 8/2004 |
| EP | 1493845 | A1 | 1/2005 |
| WO | 97/20081 | | 6/1997 |
| WO | 97/20083 | | 6/1997 |
| WO | 2007/069973 | A1 | 6/2007 |

* cited by examiner

*Primary Examiner* — Archene Turner
(74) *Attorney, Agent, or Firm* — Young & Thompson

(57) ABSTRACT

Coated cemented carbide inserts (cutting tool), particularly useful for wet or dry milling of steels, are disclosed. The cutting tool insert is characterized by a cemented carbide body comprising WC, NbC and TaC, a W-alloyed Co binder phase, and a coating comprising an innermost layer of $TiC_xN_yO_z$ with equiaxed grains, a layer of $TiC_xN_yO_z$ with columnar grains and a layer of $\alpha$-$Al_2O_3$.

21 Claims, 1 Drawing Sheet

COATED CUTTING INSERT FOR MILLING APPLICATIONS

CROSS REFERENCE TO RELATED APPLICATIONS

This application claims priority to Swedish Application No. 0702045-6 filed Sep. 13, 2007, the entire disclosure of which is incorporated herein by reference.

FIELD OF THE INVENTION

The present invention relates to coated cemented carbide inserts (cutting tools), particularly useful for wet or dry milling of steels.

BACKGROUND OF THE INVENTION

When machining low and medium alloyed steels and stainless steels with cemented carbide tools, the cutting edge is worn according to different wear mechanisms, such as chemical wear, abrasive wear, and adhesive wear and by edge chipping caused by cracks formed along the cutting edge. The domination of any of the wear mechanisms is determined by the application, and is dependent on properties of the machined material, applied cutting parameters, and the properties of the tool material. In general, it is very difficult to improve all tool properties simultaneously, and commercial cemented carbide grades have usually been optimized with respect to one or few of the above mentioned wear types, and have consequently been optimized for specific application areas.

EP 1493845 relates to a coated cemented carbide insert (cutting tool), particularly useful for milling of stainless steels and super alloys but also milling of steels in toughness demanding applications. The cutting tool insert is characterised by a cemented carbide body comprising WC, NbC and TaC, a W-alloyed Co binder phase, and a coating comprising an innermost layer of $TiC_xN_yO_z$ with equiaxed grains, a layer of $TiC_xN_yO_z$ with columnar grains and a layer of $\alpha$-$Al_2O_3$.

WO 97/20083 discloses a coated cutting insert particularly useful for milling of low and medium alloyed steels and stainless steels with raw surfaces such as cast skin, forged skin, hot or cold rolled skin or pre-machined surfaces under unstable conditions. The insert is characterized by a WC—Co cemented carbide with a low content of cubic carbides and a rather low W-alloyed binder phase and a coating including an innermost layer of $TiC_xN_yO_z$ with columnar grains and a top layer of TiN and an inner layer of $\kappa$-$Al_2O_3$.

WO 97/20081 describes a coated milling insert particularly useful for milling in low and medium alloyed steels with or without raw surface zones during wet or dry conditions. The insert is characterized by a WC—Co cemented carbide with a low content of cubic carbides and a highly W-alloyed binder phase and a coating including an inner layer of $TiC_xN_yO_z$ with columnar grains, an inner layer of $\kappa$-$Al_2O_3$ and, preferably, a top layer of TiN.

EP 1103635 discloses a cutting tool insert particularly useful for wet and dry milling of low and medium alloyed steels and stainless steels as well as for turning of stainless steels. The invented cutting tool is comprised of a cemented carbide body with a coating consisting of an MTCVD Ti(C, N) layer and a multi-layer coating being composed of $\kappa$-$Al_2O_3$ and TiN or Ti(C,N) layers.

WO 2007/069973 discloses a coated cutting tool insert particularly useful for dry and wet machining, preferably milling, in low and medium alloyed steels, stainless steels, with or without raw surface zones. The insert is characterized by a WC—TaC—NbC—Co cemented carbide with a W alloyed Co-binder phase and a coating including an innermost layer of $TiC_xN_yO_z$ with columnar grains and a top layer at least on the rake face of a smooth $\alpha$-$Al_2O_3$.

What is needed is a coated cutting tool with enhanced performance for milling of steel. The invention is directed to these, as well as other, important needs.

SUMMARY OF THE INVENTION

Accordingly, the invention is directed to

The cutting tool insert according to the present invention includes a cemented carbide substrate with a relatively low amount of cubic carbides, with a relatively high binder phase content, that is medium to highly alloyed with W and a fine to medium WC grain size. This substrate is provided with a wear resistant coating comprising an equiaxed $TiC_xN_yO_z$ layer, a columnar $TiC_xN_yO_z$ layer, and at least one $\alpha$-$Al_2O_3$ layer.

In one embodiment, the invention is directed to cutting tool inserts, comprising:

- a cemented carbide body; and
- a coating;
- wherein said body has a composition comprising:
  - about 9.3-10.9 wt % Co;
  - about 0.5-2.5 wt % of metals selected from the group consisting of Group IVb metal, Group Vb metal, Group VIb metal, and combinations thereof; and
  - balance WC;
- wherein said body has a coercivity of about 10-15, and an S-value of about 0.81-0.95; and
- wherein said coating comprises:
- a first (innermost) layer of $TiC_xN_yO_z$, wherein about $0.7 \leqq x+y+z \leqq$ about 1, with equiaxed grains and a total thickness<about 1 μm;
- a second layer of $TiC_xN_yO_z$ with about $0.7 \leqq x+y+z \leqq$ about 1, with a thickness of about 1-5 μm with columnar grains; and
- a layer of textured $Al_2O_3$ consisting of an $\alpha$-phase with a thickness of about 1-5 μm.

In another embodiment, the invention is directed to methods of making a cutting tool insert comprising a cemented carbide body and a coating, said method comprising:

- preparing by a powder metallurgical technique, a cemented carbide body having a composition comprising:
  - about 9.3-10.9 wt % Co;
  - about 0.5-2.5 wt % of metals selected from the group consisting of Group IVb metal, Group Vb metal, Group VIb metal, and combinations thereof; and
  - balance WC;
  - wherein said body has a coercivity of about 10-15, and an S-value of about 0.81-0.95; and
- coating the cemented carbide body with
  - a first (innermost) layer of $TiC_xN_yO_z$, wherein about $0.7 \leqq x+y+z \leqq$ about 1, with equiaxed grains and a total thickness<about 1 μm using known CVD-technique,
  - a second layer of $TiC_xN_yO_z$ with about $0.7 \leqq x+y+z \leqq$ about 1, with a thickness of about 1-5 μm with columnar grains using medium temperature chemical vapor deposition (MTCVD)-technique with acetonitrile as the carbon and nitrogen source for forming the layer in the temperature range of 700-950° C.; and,
  - a layer of textured $Al_2O_3$ consisting of an $\alpha$-phase with a thickness of about 1-5 μm using known CVD-technique; and
- optionally, depositing a thin TiN top layer on the $\alpha$-$Al_2O_3$ layer.

In yet other embodiments, the invention is directed to methods for wet or dry milling of steel, comprising the step of:

using a cutting tool insert according to claim 1 at a cutting speed of about 75-400 m/min, with an average feed per tooth of about 0.08-0.5 mm.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Figure 1:
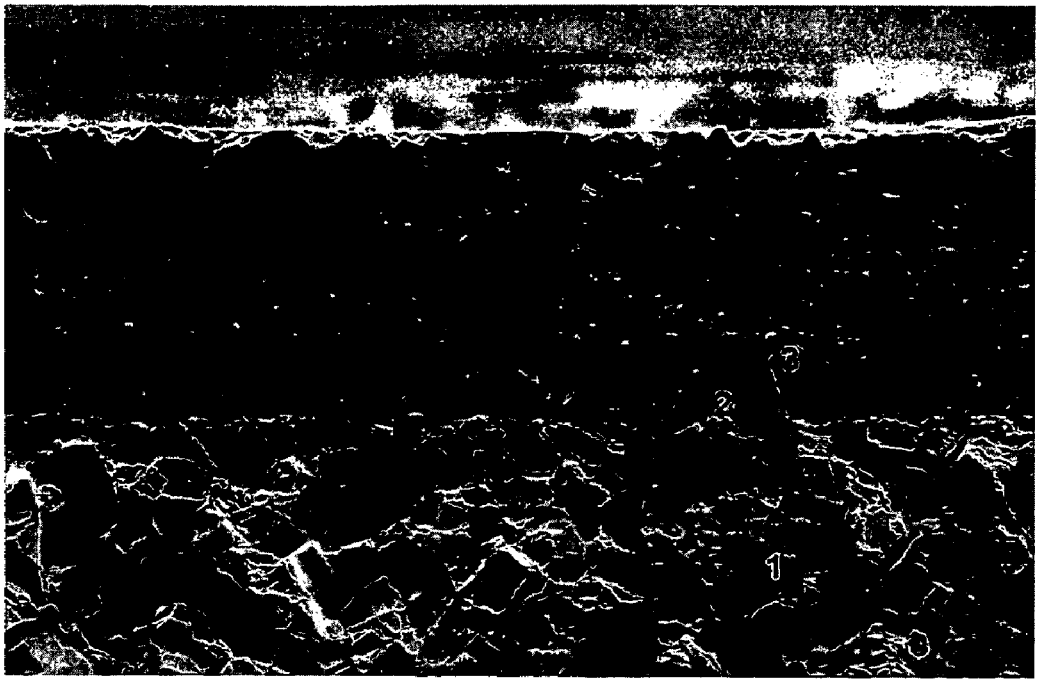
FIG. 1 shows in 16000× a scanning electron microscopy image of a fracture cross section of a cemented carbide insert according to the present invention in which 1. Cemented carbide body,
2. Innermost $TiC_xN_yO_z$ layer,
3. $TiC_xN_yO_z$ layer with columnar grains and
4. $\alpha$-$Al_2O_3$ layer.

According to the present invention a coated cutting tool insert is provided with a cemented carbide body having a composition of 9.3-10.9 wt-% Co, preferably 9.75-10.7 wt-% Co, most preferably 9.9-10.5 wt-% Co; 0.5-2.5 wt-%, preferably 1.0-2.0 wt-%, most preferably 1.2-1.8 wt-% total amount of the metals Ti, Nb and Ta and balance WC. Ti, Ta, and/or Nb may also be partly or completely replaced by other elements from groups IVb, Vb, or VIb of the periodic table. The content of Ti is preferably on a level corresponding to a technical impurity.

In a preferred embodiment, the ratio between the weight concentrations of Ta and Nb is within 7.0-12.0, preferably 7.6-11.4, most preferably 8.2-10.5.

In an alternative preferred embodiment, the ratio between the weight concentrations of Ta and Nb is within about 1.0-5.0, preferably about 1.5-4.5.

The cobalt binder phase is medium to highly alloyed with tungsten. The content of W in the binder phase may be expressed as the S-value=$\sigma$/16.1, where $\sigma$ is the magnetic moment of the binder phase in $\mu Tm^3kg^{-1}$. The S-value depends on the content of tungsten in the binder phase and increases with a decreasing tungsten content. Thus, for pure cobalt, or a binder in a cemented carbide that is saturated with carbon, S=1, and for a binder phase that contains W in an amount that corresponds to the borderline to formation of $\eta$-phase, S=0.78.

The cemented carbide body has an S-value within the range 0.81-0.95, preferably 0.82-0.93, most preferably 0.85-0.90.

The cemented carbide body has a coercivity (Hc) of 10-15, preferably 11-14, most preferably 11.5-13.5 kA/m.

The coating comprises:

a first (innermost) layer of $TiC_xN_yO_z$ with $0.7 \leqq x+y+z \leqq 1$, preferably $z<0.5$, more preferably $y>x$ and $z<0.2$, most preferably $y>0.7$, with equiaxed grains and a total thickness <1 μm preferably >0.1 μm;

a layer of $TiC_xN_yO_z$ with $0.7 \leqq x+y+z \leqq 1$, preferably with $z<0.2$, $x>0.3$ and $y>0.2$, most preferably $x>0.4$, with a thickness of 1-5 μm, preferably 1.5-4.5 μm, most preferably 2-4 μm, with columnar grains;

a layer of $Al_2O_3$ consisting of the $\alpha$-phase. The $Al_2O_3$ layer has a thickness of 1-5 μm, preferably 1.5-4.5 μm, and most preferably 2-4 μm;

In a preferred embodiment, the $Al_2O_3$ layer is strongly textured in the (10 $\bar{1}$4)-direction, with a texture coefficient TC(10$\bar{1}$4) larger than 1.2, preferably between 1.4 and 4.

The texture coefficient (TC) for the alumina layer is determined according to the following formula:

$$TC(hkil) = \frac{I(hkil)}{I_0(hkil)}\left[\frac{1}{n}\sum_{n=1}^{n}\frac{I(hkil)}{I_0(hkil)}\right]^{-1}$$

where

I(hkil)=measured intensity of the (hkil) reflection $I_0$(hkil)=standard intensity according to JCPDS card no 46-1212 n=number of reflections used in the calculation (hkil) reflections used are: (10$\bar{1}$2), (10$\bar{1}$4), (11$\bar{2}$0), (0006), (11$\bar{2}$3), (11$\bar{2}$6). Consequently, n=6 and the maximum value of the texture coefficient is 6.

In an alternative embodiment, the $Al_2O_3$ layer is strongly textured in the (0006)-direction, with a texture coefficient TC(0006) larger than 1.2, preferably between 1.4 and 4.3.

In another alternative embodiment, the $Al_2O_3$ layer is strongly textured in the (10$\bar{1}$2)-direction, with a texture coefficient TC(10$\bar{1}$2) larger than 2.5, preferably larger than 3, most preferably larger than 3.5.

In a further alternative embodiment, there is a thin, less than 1 μm thick, TiN top layer on the $\alpha$-$Al_2O_3$ layer.

The present invention also relates to a method of making a cutting insert by powder metallurgical technique, wet milling of powders forming hard constituents and binder phase, compacting the milled mixture to bodies of desired shape and size and sintering, comprising a cemented carbide substrate and a coating. According to the method a substrate is provided with a composition of 9.3-10.9 wt-% Co, preferably 9.75-10.7 wt-% Co, most preferably 9.9-10.5 wt-% Co; 0.5-2.5 wt-%, preferably 1.0-2.0 wt-%, most preferably 1.2-1.8 wt-% total amount of the metals Ti, Nb and Ta and balance WC. Ti, Ta, and/or Nb may also be replaced by other elements from groups IVb, Vb, or VIb of the periodic table. The content of Ti is preferably on a level corresponding to a technical impurity.

In a preferred embodiment, the ratio between the weight concentrations of Ta and Nb is within 7.0-12.0, preferably 7.6-11.4, most preferably 8.2-10.5.

In an alternative preferred embodiment, the ratio between the weight concentrations of Ta and Nb is within 1.0-5.0, preferably 1.5-4.5.

The coercivity depends on the grain size of the starting powders and milling and sintering conditions and has to be determined by experiments. The desired S-value depends on the starting powders and sintering conditions and also has to be determined by experiments.

The layer of $TiC_xN_yO_z$ with $0.7 \leqq x+y+z \leqq 1$, preferably with $z<0.2$, $x>0.3$ and $y>0.2$, most preferably $x>0.4$, having a morphology of columnar grains, is deposited with MTCVD-technique onto the cemented carbide using acetonitrile as the carbon and nitrogen source for forming the layer in the temperature range of 700-950° C.

The innermost $TiC_xN_yO_z$ layer and alumina layers are deposited according to known technique.

In an alternative embodiment, a thin, less than 1 μm, TiN top layer is deposited on the $\alpha$-$Al_2O_3$ layer using known technique.

In a further preferred embodiment, the cutting tool insert as described above is treated after coating with a wet blasting or brushing operation, such that the surface quality of the coated tool is improved.

The invention also relates to the use of cutting tool inserts according to the above for wet or dry milling of steels at cutting speeds of 75-400 m/min, preferably 100-300 m/min, with an average feed per tooth of 0.08-0.5 mm, preferably 0.1-0.4 mm, depending on cutting speed and insert geometry.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned hereunder are incorporated herein by reference. Unless mentioned otherwise, the techniques employed or contemplated herein are standard methodologies well known to one of ordinary skill in the art. The materials, methods, and examples are illustrative only and not limiting.

The present invention is further defined in the following Examples, in which all parts and percentages are by weight and degrees are Celsius, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

EXAMPLE 1

Grade A: A cemented carbide substrate in accordance with the invention with the composition 10.3 wt % Co, 1.35 wt % Ta, 0.15 wt % Nb and balance WC, with a binder phase alloyed with W corresponding to an S-value of 0.87 was produced by conventional milling of the powders, pressing of green compacts and subsequent sintering at 1430° C. The Hc value of the cemented carbide was 12.5 kA/m, indicating a mean intercept length of about 0.7 μm. The substrate was coated with a 0.2 μm thick layer of TiN layer, having equiaxed grains, a 2.9 μm thick layer of columnar $TiC_xN_yO_z$ deposited at 835-850° C. with acetonitrile as carbon and nitrogen source, yielding an approximated carbon to nitrogen ratio x/y=1.5 with z<0.1, and a 3.1 μm thick layer of $\alpha$-$Al_2O_3$ deposited at about 1000° C. X-ray diffraction showed that the $\alpha$-$Al_2O_3$ layer had a TC(10$\bar{1}$4) of 2.1. FIG. 1 shows in 16000× a scanning electron microscopy image of a fracture cross section of the coated cemented carbide. The cutting tool insert was treated after coating with a wet blasting operation.

Grade B: A cemented carbide substrate according to Grade A was combined with a 3 μm Ti(C,N) and a 3 μm multi-layer coating of four $\kappa$-$Al_2O_3$ and five TiN layers.

Grade A and B were tested in a face milling operation in steel.

| Operation | Face milling |
|---|---|
| Cutter diameter | 160 mm |
| Material | St 52-3 |
| Insert type | SEEX1204AFTN-M14 |
| Cutting speed | 190 m/min |
| Feed | 0.25 mm/tooth |
| Depth of cut | 3 mm |
| Width of cut | 130 mm |
| **Results** | **Tool life (min)** |
| Grade A (grade according to invention) | 300 |
| Grade B | 160 |

The test was stopped at the same maximum flank wear. The wear resistance was much improved with the grade according to the invention.

EXAMPLE 2

Grade C: A cemented carbide substrate with the composition 13 wt % Co, 1.35 wt % Ta, 0.15 wt % Nb and balance WC, with a binder phase alloyed with W corresponding to an S-value of 0.85 and a Hc value of 14 kA/m was coated in accordance with Grade A.

Grade D: A cemented carbide substrate in with the composition 12 wt % Co, 1.3 wt % Ta, 0.2 wt % Nb and balance WC, with a binder phase alloyed with W corresponding to an S-value of 0.89 and a Hc value of 13 kA/m was coated in accordance with Grade A.

Grades A, C and D were tested in a square shoulder milling operation in steel.

| Operation | Square shoulder milling |
|---|---|
| Cutter diameter | 63 mm |
| Material | AISI 4142 |
| Insert type | XOMX180608TR-MD15 |
| Cutting speed | 200 m/min |
| Feed | 0.18 mm/tooth |
| Depth of cut | 12 mm |
| Width of cut | 36 mm |
| **Results** | **Tool life (min)** |
| Grade A (grade according to invention) | 300 |
| Grade C | 224 |
| Grade D | 168 |

The test was stopped at the same maximum flank wear. The tool life was significantly lower for the grades with higher binder phase content.

When ranges are used herein for physical properties, such as molecular weight, or chemical properties, such as chemical formulae, all combinations and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A cutting tool insert, comprising:

a cemented carbide body; and a coating;

wherein said body has a composition comprising:

about 9.3-10.9 wt% Co;

about 0.5-2.5 wt% of metals selected from the group consisting of Group IVb metal, Group Vb metal, Group VIb metal, and combinations thereof; and balance WC;

wherein said body has a coercivity of about 10-15 kA/m, and an S-value of about 0.81-0.95; and wherein said coating consists of:

a first (innermost) layer of $TiC_xN_yO_z$, with $0.7 \leqq x+y+z \leqq$ about 1, with equiaxed grains and a total thickness<about 1 μm;

a second layer of $TiC_xN_yO_z$ with $0.7 \leqq x+y+z \leqq$ about 1, with a thickness of about 1-5 μm with columnar grains; and an outer layer of strongly textured $Al_2O_3$ consisting of an α-phase with a thickness of about 1-5 μm.

2. A cutting tool insert according to claim 1, wherein said Group IVb metal is Ti.

3. A cutting tool insert according to claim 1, wherein said Group Vb metal is at least one metal selected from the group consisting of Nb and Ta.

4. A cutting tool insert according to claim 1, wherein said Co is present at a level of about 9.75-10.7 wt%.

5. A cutting tool insert according to claim 1, wherein said metals selected from the group consisting of Group IVb metal, Group Vb metal, Group VIb metal, and combinations thereof are present at a level of about 1.0-2.0 wt%.

6. A cutting tool insert according to claim 1, wherein said body has a coercivity of about 11-14 kA/m, and an S-value of about 0.82-0.94.

7. A cutting tool insert according to claim 1, wherein in said first (innermost) layer of $TiC_xN_yO_z$, z<about 0.5.

8. A cutting tool insert according to claim 1, wherein in said first (innermost) layer of $TiC_xN_yO_z$, y>x and z<about 0.2.

9. A cutting tool insert according to claim 1, wherein said first (innermost) layer of $TiC_xN_yO_z$, has a thickness>about 0.1 μm.

10. A cutting tool insert according to claim 1, wherein in said second layer of $TiC_xN_yO_z$, z<about 0.2, x>about 0.3 and y>about 0.2.

11. A cutting tool insert according to claim 1, wherein in said second layer of $TiC_xN_yO_z$, x>about 0.4.

12. A cutting tool insert according to claim 1, wherein said second layer of $TiC_xN_yO_z$ has a thickness of about 1.5-4.5 μm.

13. A cutting tool insert according to claim 1, wherein said textured $Al_2O_3$ layer has a thickness of about 1.5-4.5 μm.

14. A cutting tool insert according to claim 1, wherein the strongly textured $Al_2O_3$ layer has in a $(10\bar{1}4)$-direction, a texture coefficient $TC(10\bar{1}4)$ larger than about 1.2; or in a (0006)-direction, a texture coefficient TC(0006) larger than about 1.2; or in a $(10\bar{1}2)$-direction, a texture coefficient $TC(10\bar{1}2)$ larger than about 2.5;

wherein the texture coefficient (TC) is determined according to the following formula:

$$TC(hkil) = \frac{I(hkil)}{I_0(hkil)}\left[\frac{1}{n}\sum_{n=1}^{n}\frac{I(hkil)}{I_0(hkil)}\right]^{-1}$$

wherein:

I(hkil) =measured intensity of the (hkil) reflection;

$I_o$(hkil) =standard intensity according to JCPDS card no 46-1212;

n=number of reflections used in the calculation; and (hkil) reflections used are: $(10\bar{1}2)$, $(10\bar{1}4)$, $(11\bar{2}0)$, (0006), $(11\bar{2}3)$, $(11\bar{2}6)$.

15. A cutting tool insert according to claim 1, in the $(10\bar{1}4)$-direction, said texture coefficient TC(1014) is between about 1.4 and 4; or in the (0006)-direction, said texture coefficient TC(0006) is between 1.4 and 4.3; or in the $(10\bar{1}2)$-direction, said texture coefficient $TC(10\bar{1}2)$ is larger than about 3.

16. A cutting tool insert according to claim 3, wherein the ratio between the weight concentrations of Ta and Nb is about 7.0-12.0.

17. A cutting tool insert according to claim 3, wherein the ratio between the weight concentrations of Ta and Nb is about 7.6-11.4.

18. A cutting tool insert according to claim 3, wherein the ratio between the weight concentrations of Ta and Nb is about 1.0-5.0.

19. A cutting tool insert according to claim 18, wherein the ratio between the weight concentrations of Ta and Nb is about 1.5-4.5.

20. A cutting tool insert according to claim 2, wherein said Ti-content is on the level of technical impurity.

21. A cutting tool insert according to claim 1, wherein said coating further comprises a thin TiN top layer on said α-$Al_2O_3$ layer.

* * * * *